US012590767B2

(12) United States Patent
Loesch et al.

(10) Patent No.: US 12,590,767 B2
(45) Date of Patent: Mar. 31, 2026

(54) COUNTERFLOW ROTARY COOLER

(71) Applicant: INDUSTRIAL PROCESS SYSTEMS, INC., Louisville, KY (US)

(72) Inventors: Leonard A. "Lennie" Loesch, Naples, FL (US); John R. Brink, Goshen, KY (US); Oscar Mathis, III, Louisville, KY (US)

(73) Assignee: Industrial Process Systems, Inc., Louisville, KY (US)

( * ) Notice: Subject to any disclaimer, the term of this patent is extended or adjusted under 35 U.S.C. 154(b) by 82 days.

(21) Appl. No.: 18/662,827

(22) Filed: May 13, 2024

(65) Prior Publication Data

US 2025/0116467 A1 Apr. 10, 2025

Related U.S. Application Data

(60) Provisional application No. 63/501,678, filed on May 12, 2023.

(51) Int. Cl.

| | |
|---|---|
| ***F28F 5/02*** | (2006.01) |
| ***F28D 7/10*** | (2006.01) |
| ***F28D 7/12*** | (2006.01) |

(52) U.S. Cl.

CPC ..... *F28F 5/02* (2013.01); *F28D 7/106* (2013.01); *F28D 7/12* (2013.01)

(58) Field of Classification Search

CPC .. F28F 5/02; F28F 13/12; F28D 7/106; F28D 7/12; F28D 2021/0045; F28D 11/04; F28D 15/028; F26B 17/20

USPC ..... 165/89

See application file for complete search history.

(56) References Cited

U.S. PATENT DOCUMENTS

| | | | | |
|---|---|---|---|---|
| 3,788,392 | A * | 1/1974 | Abbott | F28D 11/04 366/147 |
| 3,800,865 | A * | 4/1974 | Onarheim | F28F 5/00 165/92 |
| 3,845,941 | A * | 11/1974 | Mendenhall | E01C 19/1036 366/24 |
| 10,201,820 | B2 * | 2/2019 | Forsythe | B01J 2/12 |
| 11,103,884 | B2 * | 8/2021 | Forsythe | B05B 13/0257 |
| 11,418,091 | B2 * | 8/2022 | Broomfield | H02K 3/12 |
| 11,530,881 | B2 * | 12/2022 | Trojosky | F28F 13/12 |
| 11,784,516 | B2 * | 10/2023 | Broomfield | H02K 1/16 310/80 |
| 2021/0226512 | A1 * | 7/2021 | Broomfield | H02K 9/06 |
| 2025/0116467 | A1 * | 4/2025 | Loesch | F26B 17/20 |

FOREIGN PATENT DOCUMENTS

| | | | | |
|---|---|---|---|---|
| CA | 3026581 C | * | 1/2024 | F27D 15/028 |
| EP | 3469281 B1 | * | 8/2020 | F28F 13/12 |
| WO | WO-2021146008 A1 | * | 7/2021 | H02K 1/16 |

* cited by examiner

*Primary Examiner* — Jon T. Schermerhorn, Jr.
(74) *Attorney, Agent, or Firm* — FBT Gibbons LLP

(57) ABSTRACT

A counterflow rotary cooler including an elongated rotary vessel having first and second ends, at least one inner tube nested inside one outer tube and defining an annulus space between said inner and outer tubes, with cooling water flowing from said first end to said second end through said annulus and then returning to said first end through the inner tube.

18 Claims, 5 Drawing Sheets

COUNTERFLOW ROTARY COOLER

BACKGROUND

The present invention relates to a rotary cooler. More particularly, it relates to a counterflow rotary cooler for cooling granular solids, such as coal fines, corn germ, ground corn cobs, switch grass, and many other products.

Some products, such as corn germ, are heated up to dry the germ. The germ then is cooled before being sent to storage. The germ may be cooled from about 250 degrees F. to about 100 degrees F.

Known coolers are single pass coolers. In these coolers, the cooling water enters the cooler at a first end and flows through the inside of cooling tubes, to the opposite second end, where it exits the tubes and is collected in a catch basin. The granular solid enters the cooler at the second end and flows toward the first end, in contact with the outside of the cooling tubes. After making a single pass in one direction through the cooling tubes, the water then exits the tubes and is collected in a catch basin. Water splashes everywhere; it is a very wet and messy process. There are freezing problems in the northern latitudes in the wintertime. Also, since the water is heated up as it cools the granular solid, it may leave the tubes at a high temperature, which could injure personnel if it splashes on them and may cause other environmental issues users may wish to avoid.

One manufacturer, Louisville Dryer, has used a newer design, in which the cooling water remains contained, entering the cooler at a first end and making multiple passes between the first and second ends before leaving the cooler at the first end. The granular product to be cooled enters the dryer at an opposite, second end and flows toward the first end, where it exits. The water entering at the first end flows in a first direction (toward the second end) inside a small, inner tube which is inside a larger tube. The water then exits the inner tube and flows in the opposite direction in the annulus between the inner and outer tubes, cooling the outer tube, the outer surface of which is in contact with the granular product to be cooled. The water then enters another inner tube at the first end, flowing again in the first direction, and returns in another corresponding outer tube, making multiple passes through corresponding sets of inner and outer tubes before exiting the cooler. The entire arrangement rotates, with the granular product tumbling over the outer cooling tubes. The cooling water in the annulus between the inner and outer tubes flows parallel to the granular product.

SUMMARY

An embodiment of the present invention provides a rotary cooler wherein the cooling liquid flow is reversed from that previous Louisville Dryer design to provide an improved temperature profile. In this case, the cooling fluid enters the annulus between inner and outer tubes at the first end, flows toward the second end, and then returns to the first end in the smaller inner tube, from which it then leaves the cooler. As in the previous Louisville Dryer design, the granular solid flows from the second end of the cooler to the first end, where it then exits the cooler. The granular solid is in contact with the outer surfaces of the outer tubes as it travels from the second end to the first end. In this design, the cooling fluid in contact with the inner surface of the outer tube is flowing in a first direction, from the first end to the second end, while the granular material being cooled at the outer surface of the outer tube is flowing from the second end to the first end, so this is a counterflow arrangement, with the cooling fluid flowing in the opposite direction to that of the granular material being cooled. This means that the coolest fluid, which is entering the rotary cooler at the first end, is being used to cool the coolest granular material, which is leaving the rotary cooler at the first end, thereby maintaining a substantial temperature differential between the cooling fluid and the granular material being cooled throughout the cooling process, for most effective cooling.

The coolant fluid flows first along the annular space (in one embodiment about ⅜") between inner and outer tubes, cooling down the product, and then returns via the inner tube to a rotary fitting and exits the cooler in a single pass from the first end to the second end and back. The coolant flow rate requirements in this design are higher than that of prior rotary coolers, resulting in a larger pump and higher horsepower requirements, but a much better temperature profile can be achieved, sometimes resulting in a granular product exit temperature which is lower than the coolant exit temperature.

In one embodiment, a third layer is added to the cooling tube arrangement to provide additional insulation between the cold fluid coming into the cooler and the warmed fluid exiting the cooler to hinder any undesirable heat transfer between the fluid in the outer cooling tube and the fluid in the inner cooling tube. This third layer may be an air gap, or it may be a coating, such as a ceramic coating, on the outer surface of the inner tube.

A first embodiment of the present invention provides a counterflow rotary cooler for cooling product by heat exchange with a cooling fluid. The rotary cooler comprises: an elongated rotary vessel having a vessel first end and a vessel second end, the vessel first end being at a lower elevation relative to the vessel second end; a cooling fluid inlet located proximate said vessel first end; a cooling fluid outlet located proximate said vessel first end; an outer tube having a first outer tube end and a second outer tube end and extending substantially from said vessel first end to said vessel second end inside said elongated rotary vessel, said outer tube being in fluid communication with said cooling fluid inlet; an inner tube nested inside said outer tube and having a first inner tube end and a second inner tube end extending substantially from said vessel first end to said vessel second end but terminating short of the outer tube second end, whereby said inner tube and said outer tube form a nested tube set and define an annulus between said inner tube and said outer tube through which cooling fluid flows; and a cap enclosing said outer tube second end of said nested tube set, such that when cooling fluid flows into said fluid inlet, it flows through said annulus to said outer tube second end and is directed by said cap into said inner tube at said inner tube second end and flows from said vessel second end to said vessel first end and then out said cooling fluid outlet proximate to said vessel first end; an auger disposed proximate to said vessel second end for introducing solid product into said vessel at said vessel second end; and a product outlet at said vessel first end, so that when product enters the vessel through said auger, it flows to said vessel first end and out said product outlet The first embodiment of the present invention may be further characterized in one or more of the following manners: wherein the cooling fluid inlet is essentially stationary, and the cooling fluid outlet is essentially stationary; further comprising a cooling fluid rotary joint adapted to connect the tube assembly set with the cooling fluid inlet and cooling fluid outlet; wherein the rotary vessel rotates about an axis defined along the length of the rotary cooler and the tube assembly set is coaxial with the axis; further comprising a cooling fluid rotary joint adapted to connect the tube assembly set with the cooling fluid inlet and cooling fluid outlet, and wherein the cooling fluid rotary joint rotates about the axis; further comprising a cooling fluid inlet manifold in fluid communication with a first chamber coupled with the rotary joint and a cooling fluid outlet manifold in fluid communication with a second chamber coupled with the rotary joint, the cooling fluid inlet manifold in fluid communication with the annulus of each tube assembly of the tube assembly set, and the cooling fluid outlet manifold in fluid communication with each inner tube of the tube assembly set; further comprising a first set of radially extending arms connecting the first chamber with the cooling fluid inlet manifold and a second set of radially extending arms connecting the second chamber with the cooling fluid outlet manifold; further comprising a rotating auger adapted to receive product and deliver product to the interior space via the product feed inlet; further comprising thermal insulation between the inner tube and the outer tube of each tube assembly; and wherein each tube assembly further comprises an end cap configured to redirect cooling fluid flowing from the annulus in the second direction into the inner tube to flow in the opposite first direction toward the first end.

A second embodiment of the present invention provides a method for cooling product passed through a rotary cooler by heat exchange with a cooling fluid, the rotary cooler having a cylindrical rotary vessel having first and second ends, the first end being opposite and at a lower elevation than the second end. The method comprising:

introducing product into an inlet at a second end of a rotary vessel; passing product through an interior space of a rotary vessel, the product flowing in a first direction from the second end to the first end, the product exiting the rotary vessel at the first end; introducing cooling fluid at a generally stationary cooling fluid inlet and discharging cooling fluid at a generally stationary cooling fluid outlet located near the first end of the cylindrical rotary vessel; providing a tube assembly set disposed uniformly about the interior surface of the rotary vessel, each tube assembly of the tube assembly set extending essentially the length of the rotary vessel and comprising an outer tube and an inner tube nested within the outer tube and defining an annulus in a space between the inner tube and the outer tube, the inner tube having an inlet essentially located at the first end of the rotary vessel for receiving cooling fluid and an outlet essentially located at the second end of the rotary vessel for expelling fluid into the annulus, the outer tube having an outlet essentially located at the first end of the rotary vessel, wherein the cooling fluid enters the inner tube inlet and travels in a second direction opposite the first direction and the cooling fluid travels through the annulus in the first direction back towards the cooling fluid inlet; wherein the product is physically separated from the cooling fluid and is in thermal communication with the cooling fluid running through the annulus of the tube assembly set, and wherein the cooling fluid entering the inner tube is at a temperature lower than the temperature of the product as it enters the rotary cooler whereby a heat exchange occurs between the product and the cooling fluid.

The second embodiment of the present invention may be further characterized in one or more of the following manners: wherein the cooling fluid inlet is essentially stationary, and the cooling fluid outlet is essentially stationary; further comprising providing a cooling fluid rotary joint adapted to connect the tube assembly set with the cooling fluid inlet and cooling fluid outlet; wherein the rotary vessel rotates about an axis defined along the length of the rotary cooler and the tube assembly set is coaxial with the axis; further comprising providing a cooling fluid rotary joint adapted to connect the tube assembly set with the cooling fluid inlet and cooling fluid outlet, and wherein the cooling fluid rotary joint rotates about the axis; further comprising providing a cooling fluid inlet manifold in fluid communication with a first chamber coupled with the rotary joint and a cooling fluid outlet manifold in fluid communication with a second chamber coupled with the rotary joint, the cooling fluid inlet manifold in fluid communication with the annulus of each tube assembly of the tube assembly set, and the cooling fluid outlet manifold in fluid communication with each inner tube of the tube assembly set; further comprising providing a rotating auger adapted to receive product and deliver product to the interior space via the product feed inlet; further comprising providing thermal insulation between the inner tube and the outer tube of each tube assembly.

DESCRIPTION

Figure 1:
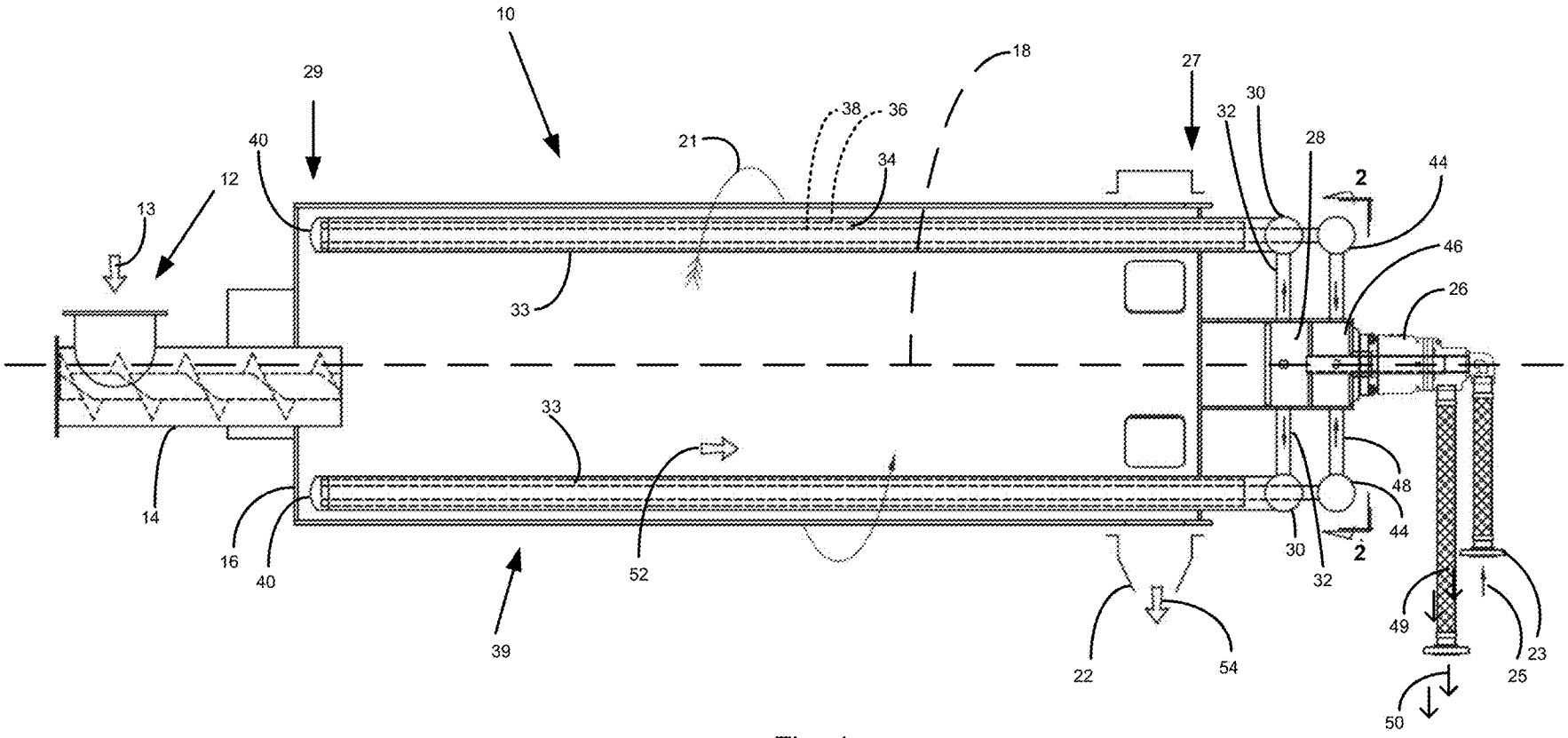
FIG. 1 is a simplified schematic of one embodiment of a counterflow rotary cooler, with only the top and bottom cooling tubes being shown for simplicity.

FIG. 1 is a sectional schematic of a rotary cooler 10 made in accordance with one embodiment of the present invention. The rotary cooler 10 includes a product feed inlet or end 12, which receives the granular product to be cooled into an auger 14, which in turn feeds the product into the cylindrical rotary vessel 16 of the rotary cooler 10. The cylindrical vessel 16 rotates about its central, longitudinal axis 18 in a direction represented by arrow 21. This rotation is accomplished by using at least two tires/live rings (sometimes called rolling rings), not shown, which ride on trunnions (sometimes called support rollers), not shown. The longitudinal axis 18 of the cylindrical vessel 16 is at a slight angle (typically about a 2% slope) relative to horizontal, so that the product feed inlet/end 12 proximate higher elevation end 29 of the vessel 16 is at a slightly higher elevation than the lower elevation/cooled product discharge end 27. The product or material 13 to be cooled enters into the vessel 16 via the auger 14 near the higher elevation end 29 (note that the material feed may be accomplished via other means, such as a chute, for instance), travels downstream along the interior of the vessel 16 toward the lower elevation end 27, and the cooled product or material 54 is output near the lower elevation end at a hopper 22. The material or product 13 is cooled as it travel along the interior of the vessel 16, with its travel along the interior of the vessel 16 being aided by the rotation of the vessel 16 and by gravity.

The cooling water 25 (other cooling fluids may be used; for simplicity we shall use the term cooling water to refer to any of the cooling fluids that may be used in this application) is introduced or brought in near the product discharge end 27 of the cylindrical vessel 16 through a rotary joint 26 which admits the cooling water 25 received from cooing water inlet pipe 23 into a first chamber 28. The first chamber 28 is in fluid communication with a cooling water inlet manifold 30 via a plurality of radially extending arms 32 (See also FIG. 3).

Figure 2:
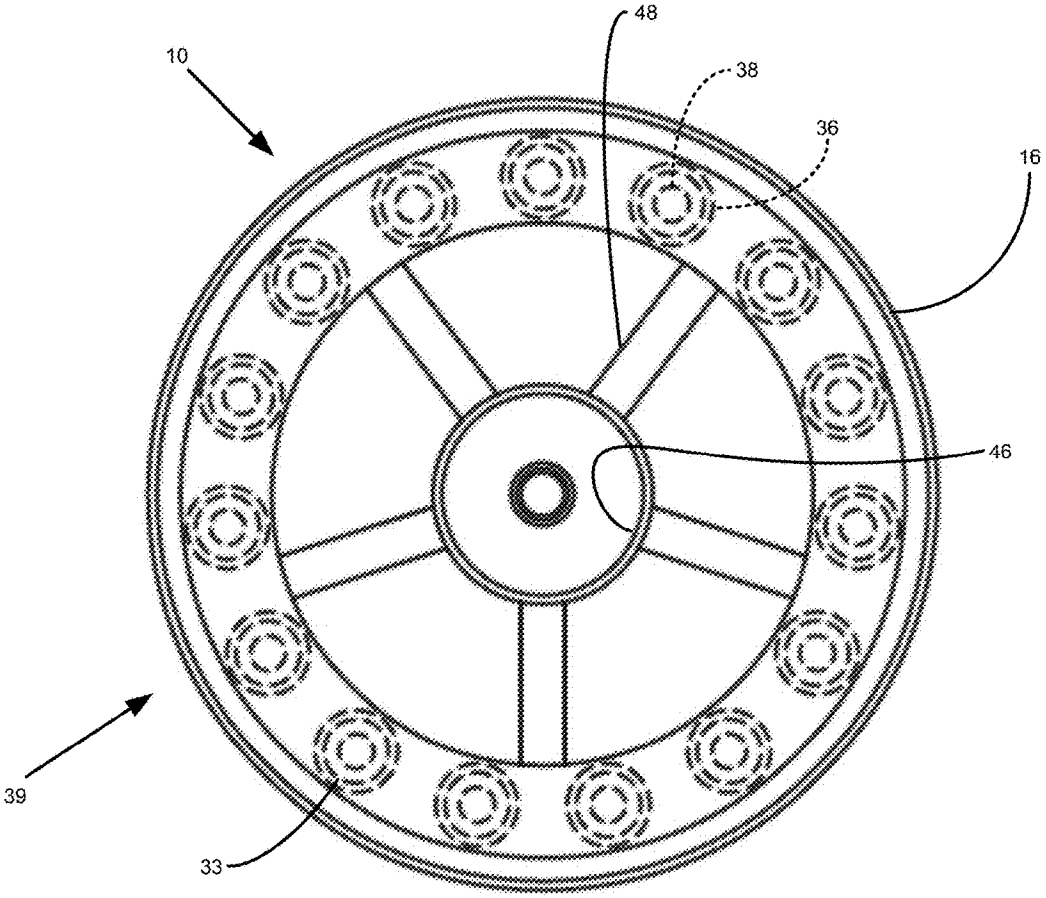
FIG. 2 is a section view along lines 2-2 of FIG. 1, but showing all the cooling tubes.
Figure 3:
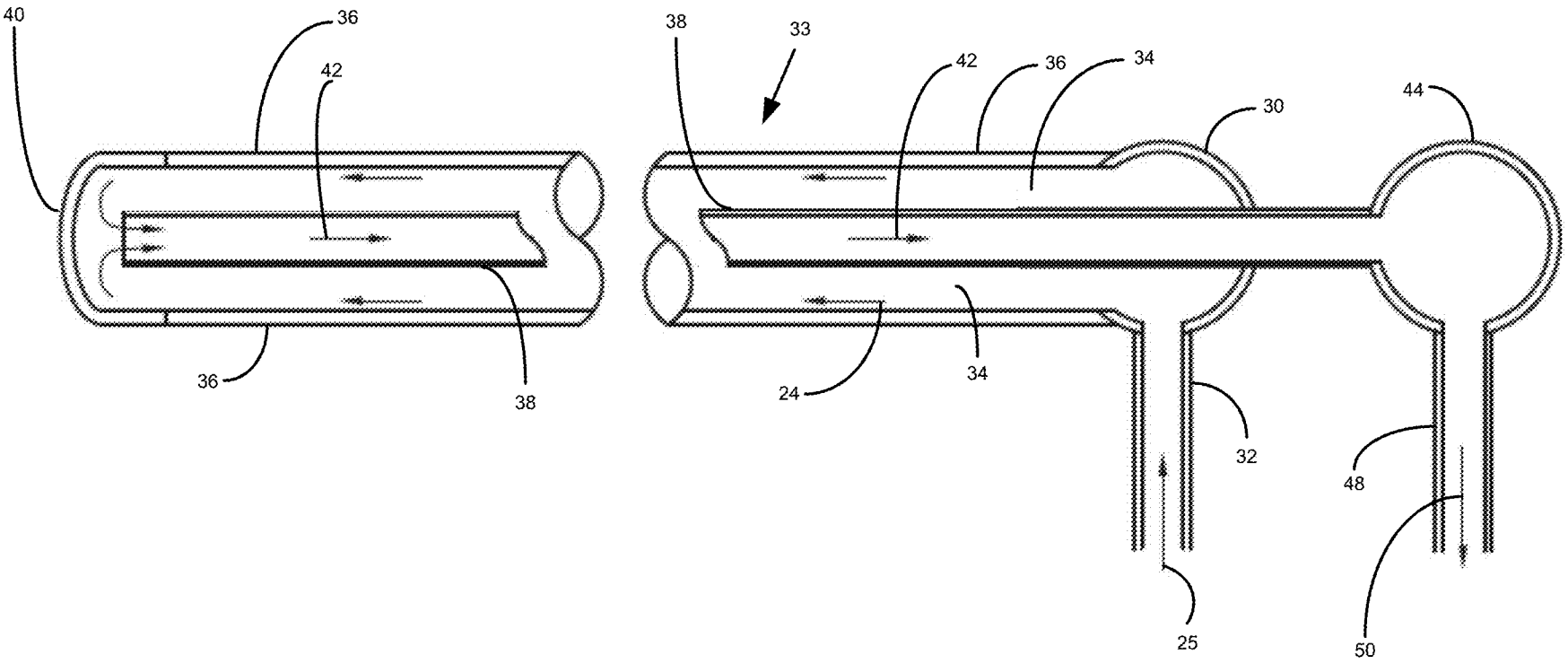
FIG. 3 is a detail view of one set of cooling tubes of the rotary cooler of FIG. 1.

Referring now to FIGS. 1 and 3, the incoming cooling water 25 in inlet tube 23 passes through the rotary joint 26 and first chamber 28 at or near the "first" (lower elevation) end/cooled product discharge end 27 of the rotary vessel 16. The cooling water 25 passes from first chamber 28 into and through the radial arms 32 and into the cooling water inlet manifold 30. As shown in FIG. 2, the rotary vessel 16 is provided with an array 39 of nested coaxial tube sets 33 made up of nested coaxial tubes 36 and 38. Each nested coaxial tube set 33 has an annulus 34 and is disposed within and along the outer periphery of the vessel and parallel with longitudinal axis 18 along the length of the vessel 16. For example, the vessel 16 of FIG. 2 shows an array 39 of 15 sets of nested tube sets 33 equally spaced along the outer periphery of the vessel.

For each nested tube set 33, the cooling water 25 travels along the annulus 34 between an outer tube 36 and a nested (concentric and co-axial) inner tube 38 toward the opposite, "second" (higher elevation) end 29 of the rotary vessel 16. A cap 40 at the second end of the nested tubes 36, 38 directs the cooling water back (See arrow 42 in FIG. 3) through the inside of the inner tube 38 to an outlet manifold 44 located at, near or adjacent to the "first" lower elevation/product discharge) end 27. The outlet manifold 44 is in fluid communication with a second chamber 46 (See FIG. 1) via a plurality of radially extending arms 48 (See also FIG. 2). The cooling water then travels out of this second chamber 46 through the rotary joint 26 and exits the system through additional piping defining outlet tube 49 to the plant (See arrow 50 in FIG. 1).

As shown in FIG. 2, there is a plurality or array 39 of the above-described tube arrangements or assemblies 33 inside the cylindrical vessel 16. (For simplicity, only two such tube arrangements are shown in FIG. 1). These tube arrangements 33 are preferably equally spaced around the inner periphery or perimeter of the circular cross-section of the vessel 16, as best appreciated in the cross-sectional end view of FIG. 2.

In this exemplary embodiment as shown in FIGS. 1 and 3, the outer tube 36 has a first outer tube end proximate the vessel first end 27 and a second outer tube end proximate the vessel second end 29 and extends substantially from the vessel first end to the vessel second end inside the elongated rotary vessel 16. The outer tube is in fluid communication with the cooling fluid inlet pipe 23 to receive the cooling fluid. The inner tube 38 is nested inside the outer tube and has a first inner tube end proximate the vessel first end 27 and a second inner tube end proximate the vessel second end 29. The inner tube 38 also extends substantially from the vessel first end to the vessel second end but terminates short of the outer tube second end, whereby the inner tube 38 and the outer tube 36 form one nested tube set 33 of an array 39 (FIG. 2) and each tube set 33 defines an annulus 34 between the inner tube 38 and the outer tube 36 through which cooling fluid flows. A cap 40 encloses the outer tube second end of the nested tube set 33, such that when cooling fluid flows into the fluid inlet, it flows through the annulus 34 to the outer tube second end and is directed by the cap into the inner tube at the inner tube second end and flows from the vessel second end 29 to the vessel first end 27 and then out the cooling fluid outlet 49/50 proximate to the vessel first end 27.

Operation:

In order to cool the granular product 13, the cylindrical vessel 16 is first started rotating. Cooling water 25 is then introduced via the inlet pipe 23 (See FIG. 1) to the rotary joint 26 and into the first chamber 28 where it is then sent, via the arms 32, to the inlet manifold 30 which distributes the water into an annular array 39 of tube assemblies 33. Tube assemblies 33 are arranged and disposed about the periphery of the inside of cylindrical rotary vessel 16. Each tube assembly 33 includes an inner tube 38 nested inside and co-axial with an outer tube 36. Each tube assembly is connected to inlet manifold 30, which distributes cooling water or fluid 25 to outer tubes 36. The cooling water flows along the annulus 34 between the outer tube 36 and the inner tube 38 from the first end 27 of the vessel 16 to the second end 29. As the cooling water reaches the second end 29, the cap 40 directs the water into the respective nested inner tube 38, through which the water flows back to the outlet manifold 44 at the first end 27. The outlet manifold 44 collects the returning water from all the inner tubes and sends the water, via the arms 48, to the second chamber 46. The water then exits the second (return) chamber 46 via the rotary joint 26 and is piped back to the plant for disposal or for cooling in a water tower.

Once this cooling water loop is established, the granular product 13 is fed into the second (higher elevation) end 29 of the cylindrical rotary vessel 16 via the auger 14. The product 13 is cooled as it travels along the inside of the cylindrical vessel 16 toward the first end 27, pushed along by the rotary motion of the vessel 16 and gravity aided by the downward slope of the vessel 16, in the direction of the arrow 52 (See FIG. 1) toward first end 27 until, eventually, the product 13 is expelled from the vessel 16 via the hopper 22 (See arrow 54). During the product's travel along the length of the vessel 16, it comes in contact, directly or by an intermediate structure such as a cylindrical wall, with the outer surfaces of the outer tubes 36, and heat is transferred from the granular product to the outer tubes 36, and to the cooling water 25 in the tubes 36, thereby cooling the granular product.

Figure 4:
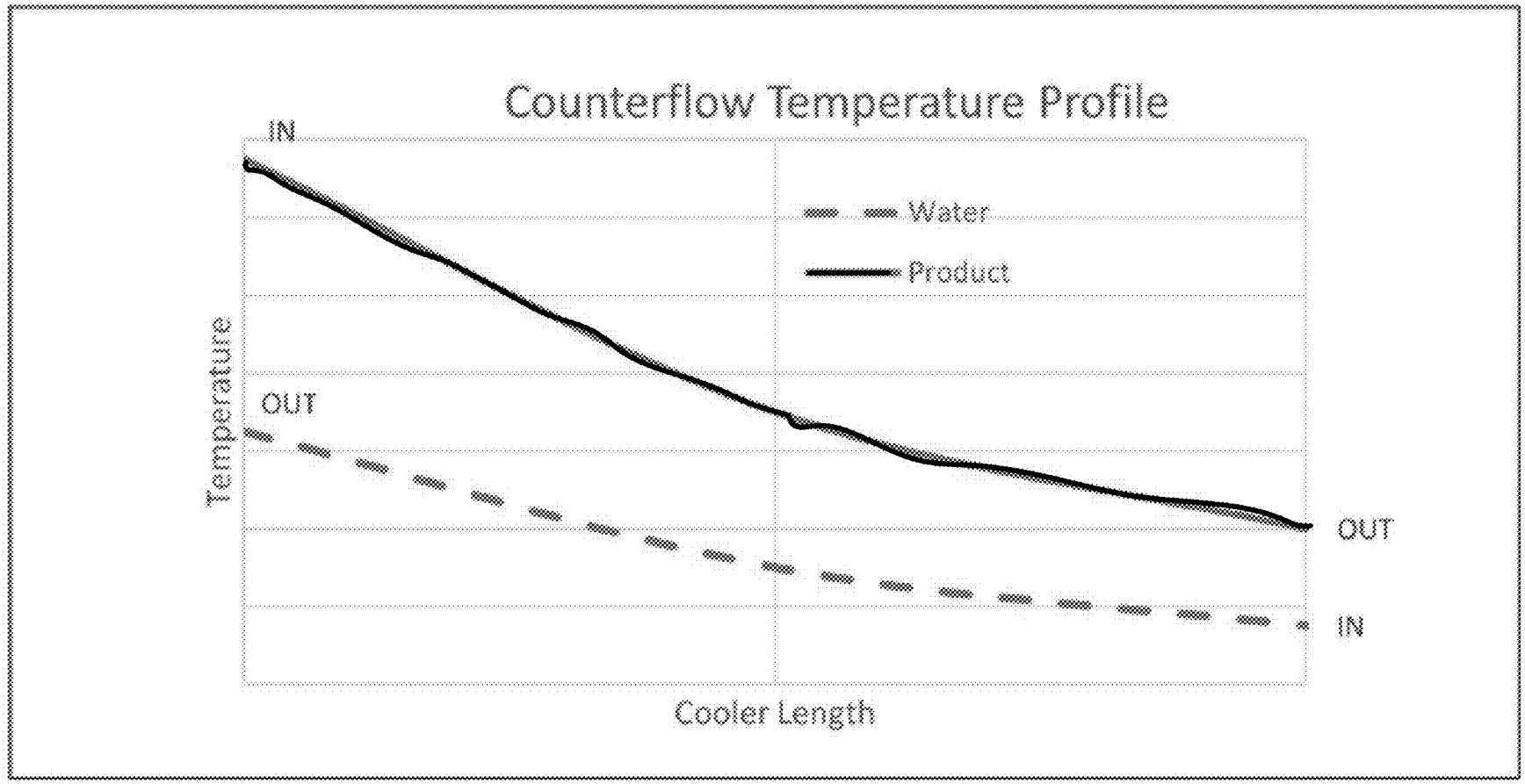
FIG. 4 is a chart showing a temperature profile which may be achieved using the rotary cooler of FIG. 1.

The flow of the product as it is being cooled is from the product inlet 12 (at the second (higher elevation) end 29 of the vessel 16) to the product outlet at hopper 22 (at the first (lower elevation) end 27 of the vessel 16), while the flow of the cooling water is from the inlet manifold 30 (at the first (lower elevation) end 27 of the vessel 16) to the cap 40 at the second end 29 of the vessel 16 and then back to the first end 27 via the inner tube 38 to the outlet manifold 44. In this manner, a counterflow arrangement is established with the hot material 13 traveling in a first direction 52 and the cooling water in annulus 34 of each nested tube set traveling in an opposite direction 24. As the cooling water returns inside the inner tube 38 to the outlet manifold 44, the cooling water is not in contact with the surface of the outer tube 38 and therefore does not directly absorb heat from the granular product inside vessel 16. Thus, the cooling water which is absorbing heat from the granular product during the cooling process is flowing from the first end 27 of the vessel 16 to the second end 29 of the vessel 16, which is against or countercurrent to the flow of the granular product, which is flowing from the second end 29 of the vessel 16 to the first end 27 of the vessel 16. This countercurrent flow arrangement maintains a substantial temperature differential throughout the cooling process and may result in the product temperature exiting the vessel 16 being even lower than the cooling water temperature exiting the rotary cooler 10, as show schematically in FIG. 4.

As shown in FIG. 3, the returning, now-warmer, cooling water (See arrow 42), exits the tube arrangement through the inner tube 38 at the first end 27 of the vessel. This warmer cooling water may heat the inner tube 38 to some extent and thereby may pre-heat the incoming cold water (see arrow 24), which is flowing in the annulus between the inner tube 38 and the outer tube 36. This is undesirable, as any pre-heating of the cooling water reduces the temperature differential available for cooling the granular product.

To minimize or even eliminate this undesirable heat transfer, several options may be used to help insulate between the inner tube 38 and the annulus 34. One option is to fabricate the inner tube 38 from a less-thermally-conductive material than what is used for the outer tube 36, where the desired heat transfer occurs. For example, while all the tubes generally are made of stainless steel, the inner tube could be made of a ceramic or carbon fiber instead of the stainless steel used for the outer tube 36. Alternatively, an insulating coating may be put on the outer surface of a stainless steel inner tube 38, such as a ceramic coating.

Figure 5:
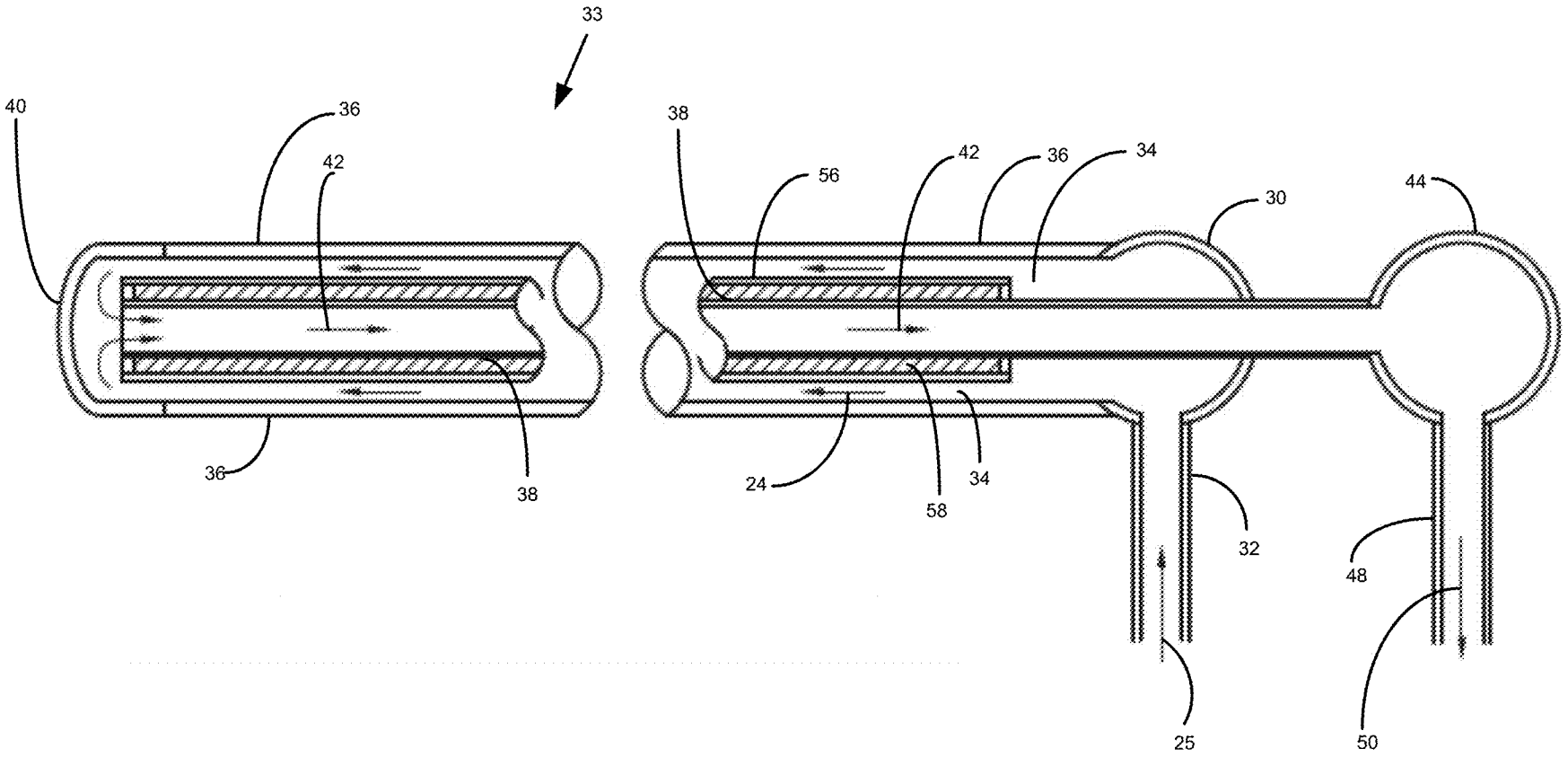
FIG. 5 is a detail view, like that of FIG. 3, but for an alternative tube arrangement including a third nested tube to provide additional insulation between the outer tube and the inner tube.

Another alternative, shown in FIG. 5, involves placing a third, intermediate tube 56 nested between the inner tube 38 and the outer tube 36 and sealed against the inner tube at both ends, thereby creating an insulating dead air space 58 in the annulus between the inner tube 38 and the intermediate tube 56.

Of course, any combination of the insulating solutions offered above may be used. For instance, the dead-air space 58 may be formed using a carbon fiber intermediate tube 56 instead of a stainless-steel intermediate tube 56.

Figure 6:
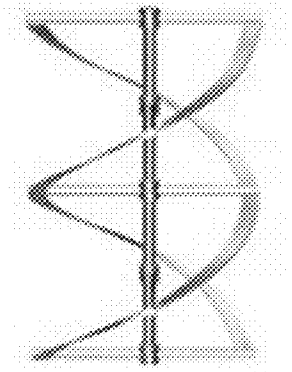
FIG. 6 is a photograph of a helical ribbon such as may be installed in the annulus between the inner tube and the outer tube to promote mixing of the cooling fluid so as to enhance the heat transfer between the cooling fluid and the granular product being cooled.

It should be noted that, in order to support the installation of an outer tube 36 around a nested inner tube 38, a plurality of shims (not shown) are securely mounted, as by welding, for instance, to the outer surface of the inner tube 38. These shims are just tall enough to allow the inner tube 38 to slide into the outer tube 36 with a tight tolerance to support the inner tube 38 inside the outer tube 36 and maintain a uniform gap between the inner and outer tubes. If, instead of a simple spacer shim, the shim is designed as an elongated helical ribbon 60 (See FIG. 6), it can be used not only to support the inner tube 38 inside the outer tube 36, but also as a means to promote mixing of the cooling fluid inside the annulus 34, which also improves the heat transfer between the cooling water and the granular product being cooled. If an intermediate tube 56 is used, shims also would be used to support the intermediate tube 56 on the inner tube and to support the outer tube 36 on the intermediate tube 56.

While the examples described above show some embodiments of a counterflow rotary cooler, it will be obvious to those skilled in the art that modifications may be made to the embodiments described above without departing from the scope of the present invention as claimed.

What is claimed is:

1. A counterflow rotary cooler for cooling solid granular material product, the cooler comprising:

an elongated rotary vessel having a vessel first end and a vessel second end, the vessel first end being at a lower elevation relative to the vessel second end;

a cooling fluid inlet located proximate said vessel first end;

a cooling fluid outlet located proximate said vessel first end;

an outer tube having a first outer tube end and a second outer tube end and extending substantially from said vessel first end to said vessel second end inside said elongated rotary vessel, said outer tube being in fluid communication with said cooling fluid inlet;

an inner tube nested inside said outer tube and having a first inner tube end and a second inner tube end extending substantially from said vessel first end to said vessel second end but terminating short of the outer tube second end, whereby said inner tube and said outer tube form a nested tube set and define an annulus between said inner tube and said outer tube through which cooling fluid flows; and a cap enclosing said outer tube second end of said nested tube set, such that when cooling fluid flows into said fluid inlet, it flows through said annulus to said outer tube second end and is directed by said cap into said inner tube at said inner tube second end and flows from said vessel second end to said vessel first end and then out said cooling fluid outlet proximate to said vessel first end;

an auger disposed proximate to said vessel second end for introducing solid product into said vessel at said vessel second end; and a product outlet at said vessel first end, so that when product enters the vessel through said auger, it flows to said vessel first end and out said product outlet.

2. The rotary cooler of claim 1 wherein the cooling fluid inlet is essentially stationary, and the cooling fluid outlet is essentially stationary.

3. The rotary cooler of claim 1 further comprising a cooling fluid rotary joint adapted to connect the tube assembly set with the cooling fluid inlet and cooling fluid outlet.

4. The rotary cooler of claim 1 wherein the rotary vessel rotates about an axis defined along the length of the rotary cooler, and further comprising an array of nested tube sets each parallel with and along the axis defined along the length of the rotary cooler.

5. The rotary cooler of claim 4 further comprising a cooling fluid rotary joint adapted to connect the array of nested tube sets with the cooling fluid inlet and cooling fluid outlet, and wherein the cooling fluid rotary joint rotates about the axis.

6. The rotary cooler of claim 5 further comprising a cooling fluid inlet manifold in fluid communication with a first chamber coupled with the rotary joint and a cooling fluid outlet manifold in fluid communication with a second chamber coupled with the rotary joint, the cooling fluid inlet manifold in fluid communication with the annulus of each tube assembly of the array of nested tube sets, and the cooling fluid outlet manifold in fluid communication with each inner tube of the array of nested tube sets.

7. The rotary cooler of claim 6 further comprising a first set of radially extending arms connecting the first chamber with the cooling fluid inlet manifold and a second set of radially extending arms connecting the second chamber with the cooling fluid outlet manifold.

8. The rotary cooler of claim 1 further comprising a rotating auger adapted to receive product and deliver product to the interior space via the product feed inlet.

9. The rotary cooler of claim 1 further comprising thermal insulation between the inner tube and the outer tube of the nested tube set.

10. The rotary cooler of claim 1 wherein the nested tube set comprises an end cap configured to redirect cooling fluid flowing from the annulus in the second direction into the inner tube to flow in the opposite first direction toward the vessel first end.

11. A method for cooling product passed through a rotary cooler according to claim 1, the method comprising:

introducing product into the inlet at the second end of the rotary vessel;

passing product through an interior space of the rotary vessel, the product flowing in a first direction from the second end to the first end, the product exiting the rotary vessel at the first end;

introducing cooling fluid at the cooling fluid inlet and discharging cooling fluid at the cooling fluid outlet;

providing the nested tube set, wherein the cooling fluid flows in the annulus in a second direction opposite the first direction;

wherein the product is physically separated from the cooling fluid and is in thermal communication with the cooling fluid running through the annulus of the nested tube set, and wherein the cooling fluid entering the inner tube at the second end is at a temperature lower than the temperature of the product as it enters the rotary cooler whereby a heat exchange occurs between the product and the cooling fluid to lower the temperature of the product as it travels through the rotary vessel.

12. The method of claim 11 wherein the cooling fluid inlet is essentially stationary, and the cooling fluid outlet is essentially stationary.

13. The method of claim 11 further comprising providing a cooling fluid rotary joint adapted to connect the nested tube set with the cooling fluid inlet and cooling fluid outlet.

14. The method of claim 11 wherein the rotary vessel rotates about an axis defined along the length of the rotary cooler and the nested tube set is parallel with the axis.

15. The method of claim 14 further comprising providing a cooling fluid rotary joint adapted to connect the nested tube set with the cooling fluid inlet and cooling fluid outlet, and wherein the cooling fluid rotary joint rotates about the axis.

16. The method of claim 15 further comprising providing a cooling fluid inlet manifold in fluid communication with a first chamber coupled with the rotary joint and a cooling fluid outlet manifold in fluid communication with a second chamber coupled with the rotary joint, the cooling fluid inlet manifold in fluid communication with the annulus of the nested tube set, and the cooling fluid outlet manifold in fluid communication with the inner tube of the nested tube set.

17. The method of claim 11 further comprising providing a rotating auger adapted to receive product and deliver product to the interior space via the product feed inlet.

18. The method of claim 11 further comprising providing thermal insulation between the inner tube and the outer tube.

* * * * *